US005193239A

United States Patent [19]

Dolce, deceased et al.

[11] Patent Number: 5,193,239

[45] Date of Patent: Mar. 16, 1993

[54] BABY FOOD BOTTLE TOOL

[76] Inventors: Cyrus R. Dolce, deceased, late of San Pedro; Theresa J. Dolce, 1711 Westmont Dr., San Pedro, Calif. 90732

[21] Appl. No.: 714,676

[22] Filed: Jun. 13, 1991

[51] Int. Cl.[5] ..... B25F 1/00

[52] U.S. Cl. ..... 7/152; 81/3.4; 81/3.48

[58] Field of Search ..... 81/3.07, 3.4, 3.48, 81/3.47, 176.15, 120, 3.09; 7/151, 152, 156

[56] References Cited

U.S. PATENT DOCUMENTS 3,043,171 7/1962 Lederer ..... 81/176.15

4,846,025 7/1989 Keller et al. ..... 81/3.4

4,982,629 1/1991 Germain ..... 81/176.15

5,003,681 4/1991 Schley ..... 81/176.15

*Primary Examiner*—Roscoe V. Parker

*Attorney, Agent, or Firm*—Christie, Parker & Hale

[57] ABSTRACT

A tool for use with baby-feeding bottles of the type which consist of a hollow cylindrical shell having a flexible, plastic, bag-like liner suspended within the shell for holding milk or the like. More particularly, the present tool includes a one-piece plastic vertically-extending portion for expelling excess air from the plastic liner and a cooperative container-opening base portion for removing the metal covers used on jars containing solid foods for infants.

5 Claims, 3 Drawing Sheets

BABY FOOD BOTTLE TOOL

The present invention relates to a tool for use with bady-feeding bottles of the type which consist of a hollow cylindrical shell having a flexible, plastic, bag-like liner suspended within the shell for holding milk or the like. More particularly, the present invention is a one-piece plastic tool for expelling excess air from the plastic liner and having a cooperative container-opening device for removing the metal covers used on jars containing solid foods for infants.

It is well known that baby-feeding bottles of the type described should have substantially all excess air removed from the region between the liner and the nipple, to avoid the baby's ingesting air bubbles during suckling. In the past, there has been no unitary, low cost, readily cleaned and sterilized device or tool for collapsing the liner sufficiently to force substantially all air out of the milk-containing chamber.

Accordingly, a primary object of the present invention is the provision of an easily-fabricated, all plastic tool designed for low cost production which may be easily cleaned and sterilized, for expelling excess air from baby bottles of the type described and which further comprises a cap-removing tool adapted to pierce and remove the metallic cover used on bady-food containers, such as the 4½ ounce and 6 ounce glass containers commonly used by the Gerber Products Company, as well as others, for packaging strained carrots, squash, fruits, and the like baby foods.

SUMMARY OF THE INVENTION

A tool for use with baby-feeding bottles of the type that comprise a hollow, cylindrical shell and a flexible, bag-like container suspended within the shell. The tool includes a base portion having a diameter substantially greater than that of the aforesaid shell and a vertically-extending cylindrical portion having an outside diameter only slightly less than the inside diameter of the shell. Within the base portion there is secured a planar member having a plurality of downwardly-extending elements for piercing and easily removing the metallic covers commonly used on containers in which foods for infants are sold.

The foregoing, and other objects and advantages of the present invention will be more fully understood and appreciated upon reading the following description of a preferred, exemplary embodiment.

Figure 1:
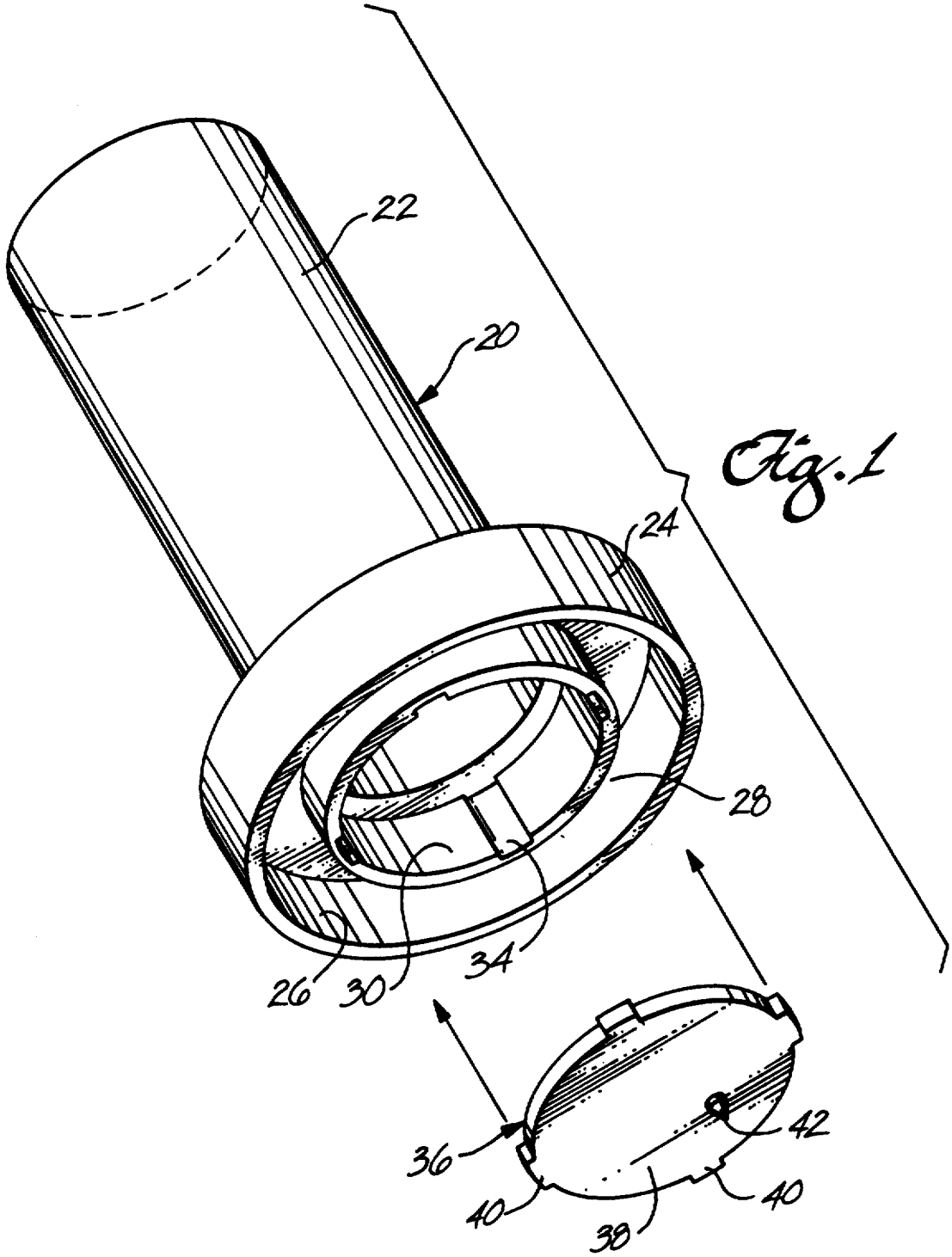
FIG. 1 is a perspective view of a baby bottle tool in accordance with the invention.
Figure 2:
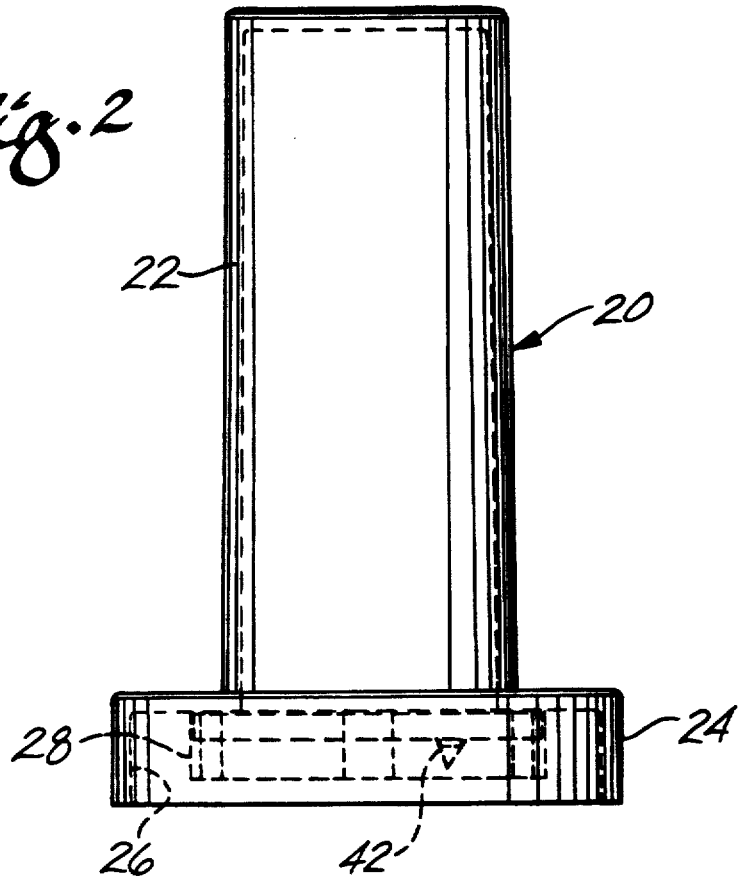
FIG. 2 is a side-elevation view of the tool illustrated in FIG. 1.
Figure 3:
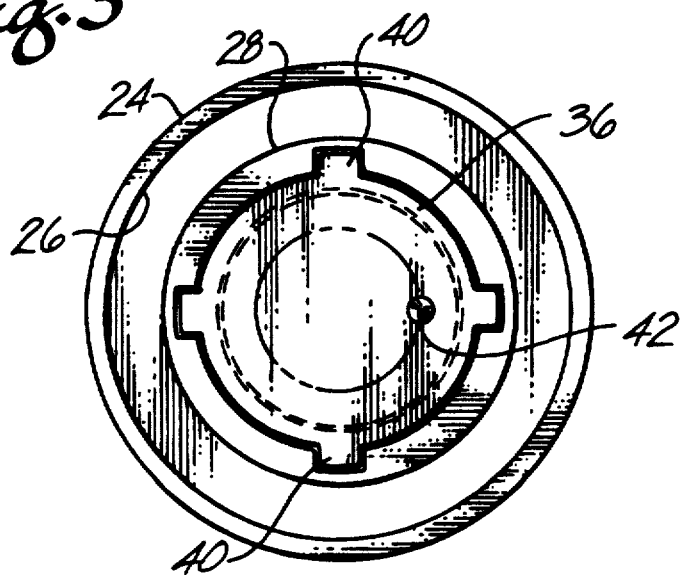
FIG. 3 is a cross-sectional view taken along the lines 3—3 of FIG. 2.

As best illustrated in FIGS. 1, 2 and 3, the tool 20 comprises a right cylindrical, post-like portion 22 and a larger-diameter base portion 24. Portion 22 has an outside diameter only slightly less than the inside diameter of cylindrical-shell baby bottles of the type described. Thus, when tool 20 is placed on a table with portion 20 extending vertically, a baby bottle of the type described may be slipped down over portion 20, with the weight of the bottle operating to collapse the plastic liner 50 (FIG. 4) thereby to expel excess air from the liner 50m through the perforated nipple 48.

Base portion 24 includes a cap-removing structure for piercing and easily removing the metallic covers used on jars containing solid foods for infants. More specifically, base portion 24 has an outer cylindrical wall 26 and an inner wall 28 of substantially smaller diameter.

Inner wall 28 of the base portion has at its inside surface 30 a plurality (preferably four) longitudinally extending slots 34 formed in wall 28. These slots preferably have a rectangular cross-section for accepting the tabs 40 of an additional component 36 (FIG. 1). Component 36 is a substantially planar and circular member preferably formed of a relatively hard polymer, such as polycarbonate. It is about ⅛ inch thick and has an outside diameter nominally corresponding to the inside diameter of inner wall 28, so that component may be press fitted within wall 28 and securely retained therein. At its periphery component 36 has four tabs or ears 40 sized and shaped to fit into and be held by the slots 34 of inner wall 28. In addition, component 36 has at least one pin 42 extending downwardly from its bottom surface 38. This pin preferably has a vertical length of about ⅜ inch, a maximum diameter at surface 38 of ¼ inch and is tapered to provide a point at the lower end having a point-radius of, nominally, about 1/64 inch. This is sharp enough to pierce the metal caps used on baby food jars without being so sharp as to constitute a risk of scatching the skin of mother or infant. In the presently preferred embodiment only one off-center positioned pin 42 is needed to serve the container-cover removing function. Alternatively, however, within the spirit and scope of the present invention, it is contemplated that one may provide and use a plurality (e.g., three) such pins spaced apart angularly and each being about ⅜ inch radially from the longitudinal axis of the base portion.

The base portion 24 preferably is formed of polypropylene, polyethylene or the like, by conventional die molding techniques. Devices in accordance with the present invention have the substantial advantage that they may be washed at high temperature in a conventional automatic dishwasher or, if preferred, may be sterilized by autoclaving or with germicide solutions.

Figure 4:
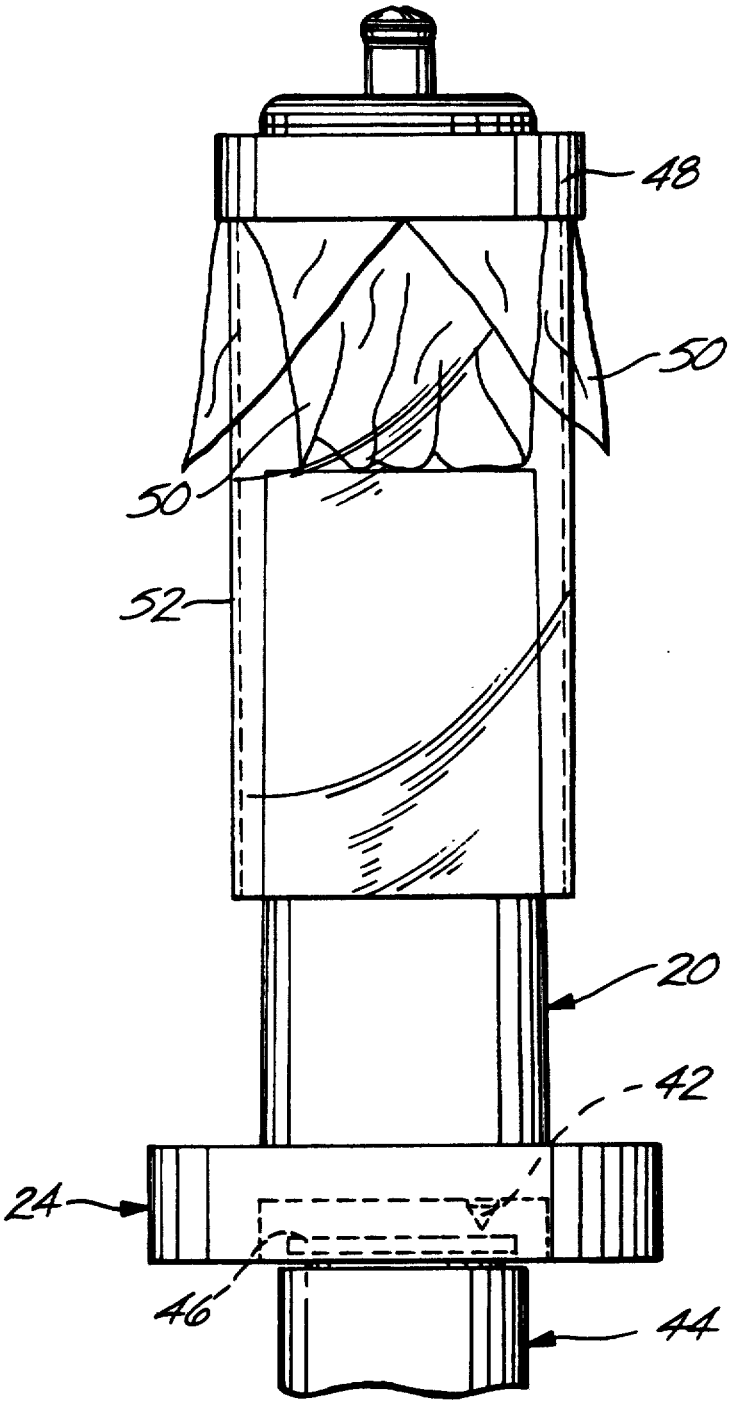
FIG. 4 illustrates use of the instant tool for opening a bottle of strained carrots while simultaneously holding, and excluding air from, a nipple-topped bottle of the type hereinabove described.

Use of a tool in accordance with the present invention is illustrated in FIG. 4. Normally, when preparing to give milk or formula to an infant, base portion 24 is placed on a flat surface, such as a table, adjacent the mother's chair. Thus, the longitudinal axis of portion 22 extends vertically, and shell 52 may be slipped downwardly over portion 22. By this arrangement, mother may hold baby with one arm and, using only one hand, push the plastic shell 52 downwardly on portion 22 far enough to force all air out through the end of nipple 48 until a small amount of milk is ejected. Further, during pauses in the feeding of the baby, tool 20 provides a convenient and secure support for holding the shell 52 against tipping, and may be used periodically to assure that no air bubbles are contained within the plastic liner.

As shown in FIG. 4, tool 20 is used for opening a glass container 44 of solid food substantially as follows. The jar 44 is placed on a horizontal surface such as a table (not shown). The jar is held against rotation with the mother's right hand while holding cylindrical portion 22 in the left hand and pressing pin 42 downwardly against the metallic bottle cap with enough force so that pin 42 punctures the cap 46 and grips it against rotation relative to tool 20. At this time, mother may rotate tool 20 counterclockwise with her left hand while cradling baby with the left arm and holding jar 44 with the right hand. This has the significant advantage that bottle 52 may be held on the top of post-like portion 22 while simultaneously holding baby and using the bottle-opener portion of base 24 to remove the cap 46 from a container of solid food.

The present invention is particularly advantageous for use in feeding infants within the age-range from about four months to about eight months. In this age range it is desirable to begin feeding the baby small amounts of strained solid food, with a small spoon, while having the milk bottle readily at hand to enable baby to take milk from the nipple for 5–10 seconds after each spoonful of solid food. The cooperative function provided by the two functional portions of a tool in accordance with the invention greatly facilitates this transitional feeding of both milk and solid foods.

While a preferred implementation of the present invention has been described in detail, it is to be understood that such is intended by way of example only and that various modifications and variations from the above-described preferred embodiment may be made. It is intended, therefore, that the following claims be deemed to encompass all modifications, permutations and variations as fall within the true spirit and scope of the present invention.

What is claimed:

1. In a tool for use with baby-feeding bottles of the type that comprise a hollow, cylindrical shell and a flexible, bag-like liner suspended within the shell, the combination of:

(a) a circular base portion having an outside diameter substantially greater than that of the baby-bottle shell;

(b) a vertically-extending cylindrical portion having an outside diameter only slightly less than the inside diameter of said shell and having a length substantially corresponding to that of said shell;

(c) with said base portion having at its bottom side a re-entrant inner wall and a substantially planar component secured within said inner wall, said planar component including at least one piercing element extending downwardly from the bottom surface of said planar component, so that said base portion may be used to pierce, engage and remove the metallic cap commonly used on containers for strained solid foods while said vertically-extending cylindrical portion is used to support said shell and expel air from the bag-like liner suspended therewithin.

2. A tool in accordance with claim 1 wherein said base portion and said vertically-extending portion are integral and are formed of polypropylene, polyethylene or another similar polymer.

3. A tool in accordance with claim 2 wherein said planar component and said piercing elements are formed of a relatively hard polymer, such as polycarbonate.

4. A tool in accordance with claim 1 wherein the inner wall of said base portion has a plurality of circumferentially spaced slots on its inner surface and said planar component has a plurality of radially extending ears for engaging said slots and securing said planar member against rotation relative to said base member.

5. A tool in accordance with claim one wherein said planar component comprises a plurality of piercing elements spaced apart angularly with respect to the longitudinal axis of said base portion and each being radially spaced from said axis. f

* * * * *

UNITED STATES PATENT AND TRADEMARK OFFICE

CERTIFICATE OF CORRECTION

PATENT NO. : 5,193,239

DATED : March 16, 1993

INVENTOR(S) : Cyrus R. Dolce (deceased)

It is certified that error appears in the above-indentified patent and that said Letters Patent is hereby corrected as shown below:

Title page, item [76], inventor: should read -- Cyrus R. Dolce, deceased, late of San Pedreo, Calif., by Teresa J. Dolce, executrix, 17112 Westmont Dr., San Pedro, Calif. 90731--.

Column 2, line 3, change "liner 50m" to -- line 50 --.

Column 4, line 35, after "axis." delete "f".

Signed and Sealed this

Ninth Day of August, 1994

*Attest:*

Bruce Lehman

BRUCE LEHMAN

*Attesting Officer*

*Commissioner of Patents and Trademarks*